United States Patent [19]

Jungerman et al.

[11] Patent Number: 4,818,468

[45] Date of Patent: Apr. 4, 1989

[54] CONTINUOUS FLOW RADIOACTIVE PRODUCTION

[75] Inventors: John A. Jungerman; Neal F. Peck; Horace H. Hines; Manuel Lagunas-Solar, all of Davis, Calif.

[73] Assignee: The Regents of the University of California, Berkeley, Calif.

[21] Appl. No.: 491,343

[22] Filed: May 9, 1983

Related U.S. Application Data

[63] Continuation of Ser. No. 821,270, Aug. 3, 1977.

[51] Int. Cl.[4] ..... G21G 1/10

[52] U.S. Cl. ..... 376/195

[58] Field of Search ..... 376/169, 195

[56] References Cited

U.S. PATENT DOCUMENTS

| | | | |
|---|---|---|---|
| 2,554,316 | 5/1951 | Reid | 176/11 |
| 2,868,987 | 1/1959 | Salsig, Jr. et al. | 176/11 |
| 2,914,450 | 11/1959 | Hammesfahr et al. | 250/492 B |
| 3,349,001 | 10/1967 | Stanton | 176/11 |
| 3,680,284 | 8/1972 | Schmeling | 176/16 |
| 3,694,313 | 9/1972 | Blue et al. . | |
| 3,745,067 | 7/1973 | Arino et al. | 176/16 |

OTHER PUBLICATIONS

BNL-18214, 9/73, Richards et al., pp. 1-5, FIG. 1, Table 1.

Int. J. of Applied Rad. and Isotopes, Dec. 1974, pp. 535-543, by Weinreich et al.

Int. J. of Applied Rad. and Isotopes, Mar. 1973, pp. 171-177, by Sodd et al.

"Self-Vapor Cooled Targets for Production of $^{123}I$ at High Current Accelerators", by Blue et al. (II), presented at the 10/18/74 ANS Meeting in Milwaukee, Wis., pp. 2,5,6,8.

Radiopharmaceuticals and Labelled Compounds, vol. 1, 1973, pp. 303-316, by Lindner et al.

Journal of Nuclear Medicine, vol. 13, 1972, pp. 729-732, by Fusco et al.

*Primary Examiner*—Harvey E. Behrend

*Attorney, Agent, or Firm*—Bertram I. Rowland

[57] ABSTRACT

A method is provided for preparing medicinally acceptable $^{123}I$ by bombarding an XI (X is alkali metal or I) target in the liquid phase with a proton beam of a predetermined amperage and energy, while continuously passing a helium stream, optionally having a small amount of xenon, through the target area. The radioactive xenon collected by the helium stream is trapped in a cold trap, purified and then isolated in a deacy vessel, where the xenon decays to $^{123}I$. An iodine scavenger is provided for the helium effluent from the target, to remove any iodine from the helium stream, which would decrease the purity of the desired isotope.

12 Claims, 3 Drawing Sheets

FIG _ 1
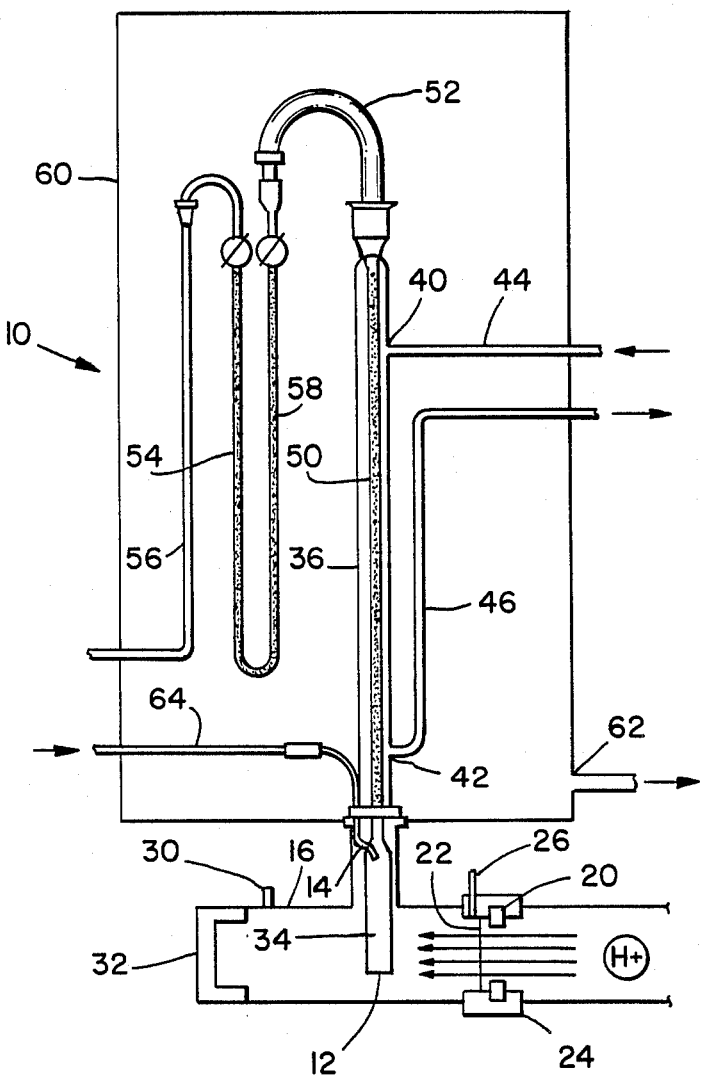
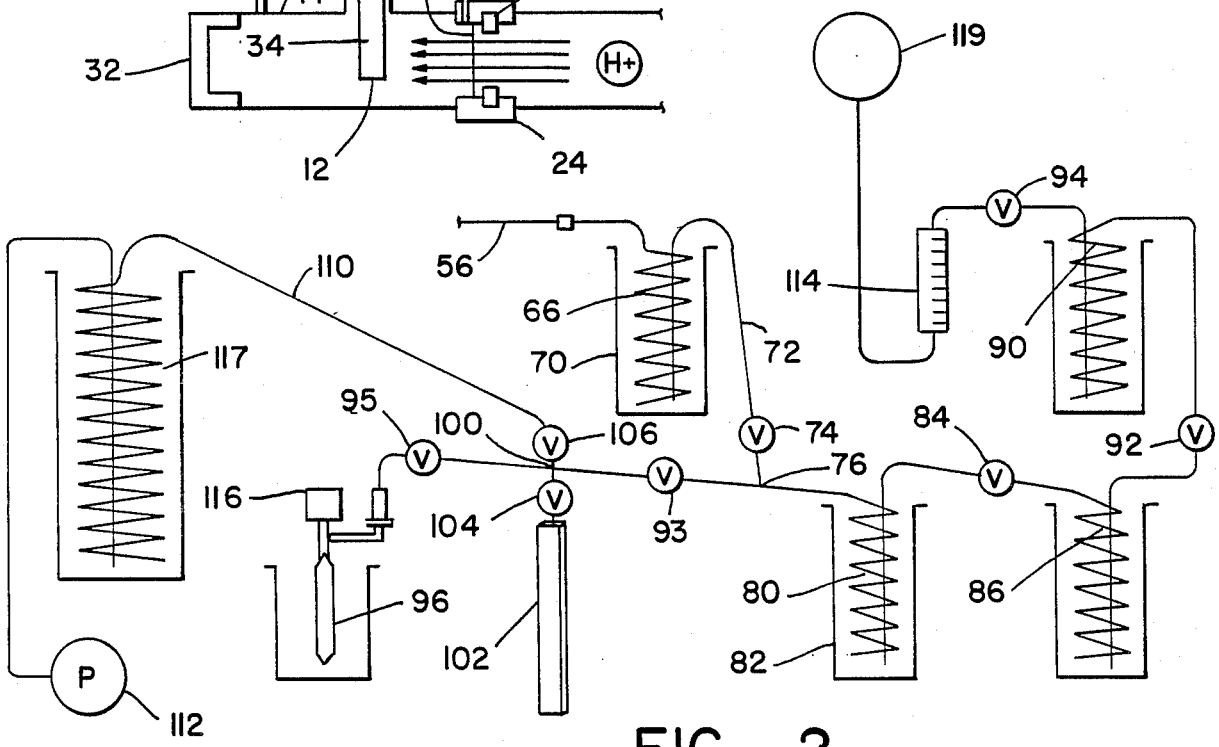
FIG _ 2

CONTINUOUS FLOW RADIOACTIVE PRODUCTION

CROSS-REFERENCE TO RELATED APPLICATIONS

This application is a continuation of application Ser. No. 821,270, filed Aug. 3, 1977, now abandoned, which is a continuation-in-part application of application Ser. No. 589,820, filed June 24, 1975, now abandoned.

BACKGROUND OF THE INVENTION

1. Field of the Invention $^{123}I$ has many advantages as a radionuclide for medicinal purposes. The radiation dose resulting from $^{123}I$ is much reduced as compared to $^{131}I$ or $^{125}I$. For most scanning situations $^{123}I$ allows scanning to be accomplished with an acceptable dose. In addition, the gamma radiation emitted is ideal for imaging with scintillation cameras. The relatively short half-life of $^{123}I$ allows other radionuclides to be used as well in diagnostic procedures without interference. The radiations resulting from $^{123}I$ are readily shielded, so as to decrease radiation hazard to personnel. While the half-life is relatively short, the $^{123}I$ half-life is sufficiently long to allow for purification and chemical labeling of compounds, delivery to the clinician, and utilization of the $^{123}I$ by the clinician. Finally, $^{123}I$ does not have undesirable particulate radiation.

In preparing the $^{123}I$ there are a number of significant considerations. Important to the process is the production of $^{123}I$ without the concomitant formation of other radionuclides which cannot be conveniently separated from the desired radionuclide and have undesirable properties, for example, particulate radiation. Because the equipment employed for the preparation of radionuclides is expensive and large amounts of energy are utilized, it is desirable that the use of the energy employed be highly efficient as it relates to the yield of the desired radionuclide. Other considerations include the cost of the target material, ease of processing, speed of processing and the like.

DESCRIPTION OF THE PRIOR ART

U.S. Pat. No. 3,694,313 discloses a process for preparing $^{123}I$ from $^{122}Te$ powder with alpha particles while passing a low flow rate helium stream through the powder to remove the xenon which is formed. U.S. Pat. No. 3,226,298 teaches irradiating tellurium dioxide with thermal neutrons at a temperature of at least about 550° C. and then separating radioactive iodine-131 by distillation. Fusco, et al, J. of Nuclear Medicine 13, 729 (1972) describes the preparation of $^{123}I$ by proton irradiation of $^{127}I$ in a batch process. Weinreich, et al, Int. J. of Applied Radiation and Isotopes, 25, 535 (1974) teaches the preparation of $^{123}I$ by irradiating solid sodium iodide in the presence of a continuous helium stream.

SUMMARY OF THE INVENTION

A method is provided for preparing medicinally and isotopically pure $^{123}I$ by irradiating an XI (X is alkali metal or iodine) target with high energy particles to produce $^{123}Xe$. The target material is maintained in the liquid state, providing reflux as required, with a continual stream of helium, optionally containing xenon, passing through the target area, while maintaining the target temperature in a predetermined range. The helium carrier aids in temperature control and sweeps out the $^{123}Xe$ radionuclide which is trapped in a cold trap and then purified by pumping the radioactive $^{123}Xe$ to the final decay vessel.

BRIEF DESCRIPTION OF THE DRAWINGS

FIG. 1 is a diagrammatic view of the target assembly;

FIG. 2 is a diagrammatic view of the collection assembly; and

DESCRIPTION OF THE SPECIFIC EMBODIMENTS

Figure 3:
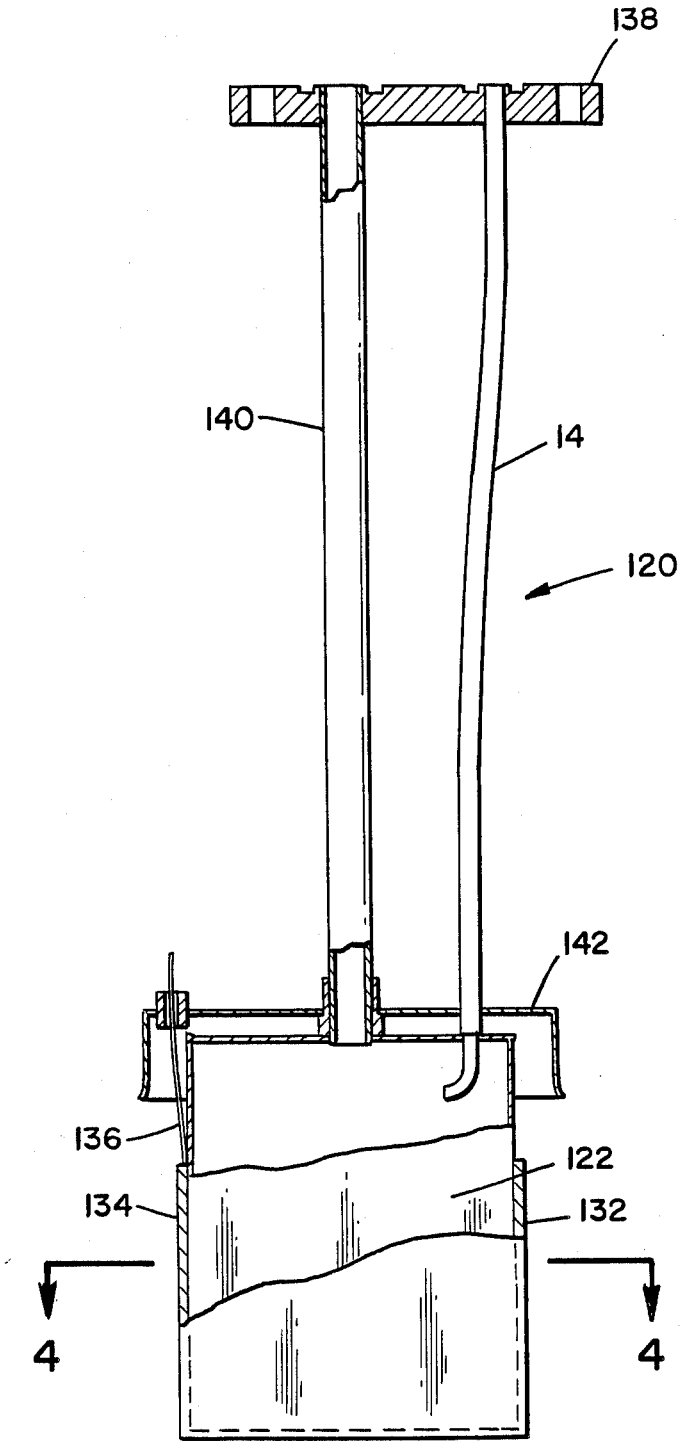
FIG. 3 is a elevation partially cut away in cross-section of a target vessel.

A method is provided for efficient production of $^{123}I$ from neat liquid XI, where X is alkali metal of atomic number 3-19, particularly sodium, or iodine. The target material is irradiated with high energy proton radiation in a predetermined energy range. The thickness of the target vessel in the radiation beam is controlled to provide a predetermined reduction in energy of the radiation beam. A gaseous stream of helium, optionally and preferably containing a small amount of naturally occurring xenon, is continuously swept through the target area, particularly across the target material surface. The target material is maintained at a temperature at or above the melting point of the target material and substantially below the boiling point of the target material. Depending upon the target material, the temperature will generally be from about 1°–100° C. above the melting point of the target material.

The temperature of the target material is continuously monitored and controlled by means of the gaseous stream, the radiation beam and an external heater, if required. A shield is provided about the target to minimize convection currents and aid in the careful control of the temperature. Normally, the beam is swept across the target area at a rate which avoids excessive local beam heating and which provides continuous production of $^{123}Xe$.

The target vessel is equipped with a reflux condenser which serves to return any entrained target material to the target vessel, as well as to cool the helium stream prior to its introduction into the collection assembly. The helium stream is then passed into an iodine scavenger which removes any iodine which has passed through the condenser. The helium stream is then directed to the collection and purification assembly.

The target vessel normally has less than about one-half of its volume unfilled by the target material. For efficient production, a substantial portion (greater than about 25%) of the target material is in the irradiation beam. The irradiation zone comprises the target material in the target vessel both within and without the irradiation beam, the cross-section of the target material without the irradiation beam being not more than about 75% of the total cross-section of the target material in the target vessel.

The collection and purification assembly comprises a plurality of spiral traps which are cooled to temperatures which allow substantially complete condensation and removal of $^{123}Xe$ from the helium stream. Normally, all of the $^{123}Xe$ will be collected in the first trap, the additional traps providing assurance that none of the radioactive xenon is lost. One or more collection and purification assemblies can be employed, so that irradiation of the target vessel is continuous until a sufficient quantity of $^{123}Xe$ is collected.

After a sufficient amount of $^{123}Xe$ has been collected in the trap, the helium flow is stopped or switched to an alternate spiral collection trap and the original collection trap connected to a decay vessel which has been previously evacuated. By warming the collection trap, the $^{123}Xe$ is efficiently transferred to the decay vessel which is cooled to a temperature below the boiling point of xenon. The decay vessel is then employed to allow the $^{123}Xe$ to decay to $^{123}I$ which may then be used in a variety of ways.

The $^{123}I$ which is obtained by the above procedure is substantially free of other undesirable radioisotopes. Desirably, the $^{123}Xe$ may be allowed to decay in the presence of chlorine to form $^{123}IC1$, which can then be employed for radioiodination procedures.

The target material will be either an alkali metal iodide, particularly sodium iodide, or mixtures of alkali metal iodides, e.g., NaI and LiI, or iodine of natural isotope distribution. Preferably, mixtures of iodides would provide the lowest melting point, e.g., eutectic mixtures.

Usually, the target will be static, that is, a fixed target material will be irradiated until $^{123}Xe$ is no longer efficiently produced. The target material will generally fill at least about one-half the volume of the target vessel and may occupy two-thirds or greater of the target vessel volume.

The radiation beam will normally employ protons having energy in the range of about 60–70, preferably about 65MeV. The irradiation target will be of a sufficient thickness to provide about a 15–25Mevy, preferably about a 20MeV energy loss of the radiation beam through the target. With molten sodium iodide, a thickness of about 10.9 mm is desirable. The microamperage of the radiation beam will be greater than about 5 $\mu$a and usually not exceed 25 $\mu$a, being in the range of about 10–20 $\mu$a or 0.6–1.2 $\mu A/cm^2$. The beam is normally swept over the target area, so as not to reside in any particular position for a time which would result in excessive heating. Therefore, the microamperage employed will be affected by the size of the beam spot, as well as the size of the target area subjected to the beam. Within these parameters, the microamperage will be chosen to optimize the yield of the desired radioisotope.

Where sodium iodide is employed as the target material, the temperature of the sodium iodide will be maintained from about 650°–720° C., preferably 650° to about 680° C. With iodine as the target the temperature will be controlled in the range of about 100°–130° C., preferably about 100°–110° C.

The helium stream will preferably have from about 0–0.2, preferably about 0.1 volume percent xenon. The xenon acts to aid in the efficient transfer of radioactive xenon from the target area and in the collection assembly. The temperature of the helium can be varied to aid in the temperature control of the target material. The rate at which the helium stream is passed through the target vessel will generally be 10–60 ml/min., more usually about 30 ml/min. The temperature of the helium stream is conveniently ambient temperature.

The helium stream acts in combination with the liquid target material to rapidly and efficiently remove $^{123}Xe$ from the irradiation zone. The irradiation beam involves greater than about 25% of the volume of the target material, so that the surface contacted by the helium stream is adjacent the radiation beam, normally being less than about 0.5" from the upper level of the irradiation beam.

In a preferred embodiment, the helium stream is heated to the temperature of the target material, by having the helium conduit in the target vessel pass through the target material about the irradiation zone in a U-shaped form and then exit from the target material and direct the helium stream downwardly onto the target material surface. In addition, a baffle plate is provided beneath the exit from the target vessel which provides for a tortuous path for the helium stream from the surface of the target material to the exit from the target vessel.

For further understanding of the invention, the drawings will now be considered. In FIG. 1 is depicted diagrammatically the target assembly 10. A target vessel 12 fitted with helium inlet tube 14 is situated in an aluminum target block 16. The target block has a carbon collimator 20 and an isolation foil 22, of stainless steel or aluminum of about 0.001 inch thickness. The carbon collimator 20 is retained in cooling block 24 which is equipped with helium inlet 26. A helium stream is introduced through helium inlet 26 and exits through helium outlet 30 so as to externally circulate around the target and minimize oxidation of the materials which might otherwise be prone to oxidation under the irradiation conditions while also providing cooling of the target. A Faraday cup 32 encloses the end of the aluminum target block 16. The aluminum target block 16 is fitted to a source of high energy radiation.

The target vessel 12 holds the target material 34 in the radiation beam in the lower portion of the target vessel. At the top, the target vessel 12 is fitted with a condenser 36 which has upper cooling fluid inlet 40 and lower cooling fluid outlet 42, connected respectively to conduits 44 and 46. The condenser 36 may be packed with glass beads 50 to aid in the heat exchange between the cooling fluid and the helium stream. The helium stream exits the condenser and is directed by connecting conduit 52 to iodine scavenge vessel 54. The iodine scavenge vessel is conveniently a tube which can be packed with chemicals 58 which will react with the iodine and remove the iodine from the helium stream. Conveniently, a combination of silver nitrate and silver wire will remove substantially all or all of the iodine which has been entrained in the helium stream. From the iodine scavenging vessel, the helium stream is directed by means of conduit 56 to the purification and collection assembly. Conveniently, the conduit can be an inert, flexible tube, such as Teflon.

The condenser 36 and scavenger 54 are contained within a hermetically sealed steel box 60 having a plexiglass window. The box 60 has an opening 62 for connection to a pump so as to maintain a mild negative pressure in the box. A plurality of openings are provided through which the various conduits are fitted for egress or ingress of the various streams. Conveniently, a helium conduit 64 is connected to the helium tube 14 through the steel box 60.

The helium stream is then directed by means of conduit 56 to the collection and purification system as depicted in FIG. 2. The helium stream is passed through a first spiral trap 66, cooled in Dewar 70 with dry ice-acetone at a temperature of about −30° to −40° C. to further cool the helium stream to a temperature above the boiling point of xenon and to remove any materials which will condense at the indicated temperature. After the initial cooling, the helium stream is then directed through conduit 72 and solenoid control valve 74 to Tee-line 76. One leg of Tee-line 76 connects with spiral trap 80 which is cooled in liquid nitrogen (~-196° C.) contained in Dewar 82. Spiral trap 80 serves to collect all, or substantially all, of the xenon in the helium stream, so that the radionuclide product is substantially completely isolated in the liquid nitrogen cooled spiral trap 80. The flow of the helium stream from spiral trap 80 is controlled by second solenoid valve 84.

To ensure that no radioactive material is vented to the atmosphere, and that all of the radionuclide product is captured, a train of additional spiral traps cooled in liquid nitrogen can be employed. Usually one or two liquid nitrogen spiral traps in addition to the collection spiral trap 80 may be employed.

In the Figure, two additional traps 86 and 90 are indicated which are cooled in liquid nitrogen. Solenoid valves 92 and 94 allow for transfer of radionuclide product from those traps to the product collection spiral trap 80. For example, if radio-nuclide has escaped from spiral trap 80 to spiral trap 86, spiral trap 80 can be cooled with liquid nitrogen and evacuated by a means which will be discussed, with both solenoid valves 84 and 92 closed. When the pressure in spiral trap 80 has been reduced to the desired level, valve 84 may be opened and spiral trap 86 slowly warmed, so that the radionuclide will transfer from spiral trap 86 to spiral trap 80.

Valve 84 is then closed and vacuum distillation employed for purification of the product in spiral trap 80. The other leg of the Tee 76 is connected through valves 93 and 95 to decay vessel 96. Between valves 93 and 95 is cross-connector 100. One of the remaining arms of cross-connector 100 connects to vacuum gauge 102 through valve 104. The other arm connects through valve 106 and line 110 to pump 112. A copper trap 117 is provided in line 110 to protect the pump. All of the spiral traps are retained in a lead shielded glove box, which is not shown, having appropriate openings for the ingress and egress of the necessary lines.

As indicated, the helium stream, containing the radionuclide xenon is directed through line 72, with the xenon being captured in spiral trap 80 and the helium stream continuing through a series of additional spiral traps and evacuated through flowmeter 114. The helium stream may be discarded, in which case it is contained in a vessel 119 to attend decay of C-11 and N-13 concomitant airborne radioactivity, or, preferably, reused with the xenon supplemented to provide the necessary amount of naturally occurring xenon in the helium stream for reuse in the target assembly. When a sufficient amount of product has been isolated in spiral trap 80, the first solenoid valve 74 is closed. The helium stream may then be directed to a second collection and purification system, whereby continuous irradiation and production of radionuclide is maintained in the target assembly. With solenoid valves 84 and 93 closed, and solenoid valves 104, 106 and 95 open, the decay vessel is evacuated to less than about 50μ Hg, preferably about 30μ Hg. The decay vessel is then cooled in liquid nitrogen, solenoid valves 104 and 106 closed, solenoid valves 74 and 84 remaining closed, and solenoid valve 95 opened. The spiral trap 80 is then allowed to warm slowly, which results in evaporation of the radionuclide xenon. Spiral trap 80 is opened to the low pressure system by opening solenoid valve 93 which results in an efficient xenon transfer to the decay vessel 96. When all of the radionuclide in spiral trap 80 has been transferred to the decay vessel, stopcock 116 is closed, sealing the decay vessel from the system. The decay vessel will then be allowed to stand for a few hours, usually about 6 hours, or can be transported to the place of use, while the $^{123}Xe$ decays to $^{123}I$.

In FIG. 3 a prototype target vessel 120 is depicted. The cross-section of the vessel in the beam direction will be chosen so as to give the desired energy reduction for the particles. Various materials may be used for the target vessel, depending upon the target material. Conveniently, stainless steel, tantalum or quartz may be employed, a stainless steel vessel having a window of 0.010 inch thickness being satisfactory with sodium iodide as the target material. The target area can be varied depending upon the capacity of the radiation beam. With a 10 μa beam, a target area $\frac{7}{8}'' \times 1\frac{1}{2}''$, with a $\frac{1}{8}''$ spot being swept across the area is found to be satisfactory. With a 20 μa beam, a target area of $1\frac{3}{4}'' \times 1\frac{1}{2}''$ may be employed to enhance production of the radionuclide.

Helium inlet tube 14 directs helium over the upper surface of the target material. Surrounding the container is a heat shield 132 having a housing 134 for a thermocouple 136. The heat shield can conveniently be of about 0.02 inches stainless steel and serves to minimize convective cooling and allow for improved temperature control. While not shown, it may be of advantage to introduce a heating element in the heat shield, so as to add the opportunity to heat the target container 122, should the irradiation beam provide insufficient heat. Flange 138 serves to position the helium inlet 14 and condenser connector tube 140, as well as provide a sealed connection between the container vessel 122 and the condenser 36. Plate 142 serves to position tubes 14 and 120 and ensure a hermetic seal with the vessel 122.

Figure 4:
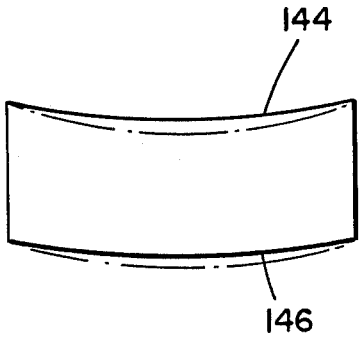
FIG. 4 is a plan view of a cross-section along line 4—4 of FIG. 3.

It is observed that after a relatively extensive period of irradiation, usually 30 hours or more, the shape of the container vessel 142 will change, so that with a rectangular container the path length through the target material increases. In FIG. 4 is depicted a container vessel having a preferred configuration, with two parallel arcuate walls. The wall receiving the irradiation is conveniently 0.010 inches thick with the other walls the same or greater thickness, e.g., 0.020 inches. A non-corrosive stainless steel can be employed, e.g. 347, and the target vessel fabricated from the same thickness material with the wall receiving the proton radiation electrostripped to the desired thickness. The arc will circumscribe a minor chord of a circle. With the parallel concave and convex walls 144 and 146, the container vessel can be used for extended periods of time without a significant change in the radiation path length through the target material. The bowing approximately cancels out, as indicated by the broken lines in FIG. 4.

Figure 5:
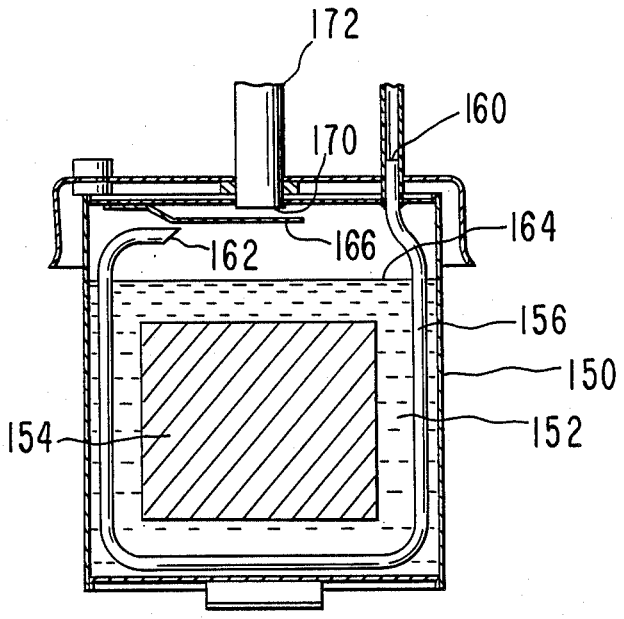
FIG. 5 is a diagrammatic elevational view of an alternative embodiment of the target assembly.

In FIG. 5, an alternate preferred embodiment of a target vessel is depicted. The target vessel 150 is substantially filled by the target material 152. The beam area 154 covers a major portion of the target material 152 cross-section and due to diffusion, all of the target material will be irradiated during the irradiation.

A helium conduit 156 has helium inlet 160. The helium conduit 156 follows the contours of the target vessel 150 adjacent the walls of the target vessel 150 defining a plane transverse to the irradiation beam. The helium conduit 156 terminates above the target material 152 and extends inwardly, with the exit 162 directing the helium stream downwardly onto the surface 164 of the target material.

A baffle plate 166 is situated above the helium conduit exit 162 and below the target vessel exit 170 to aid in directing the helium stream across the target material surface 164. Condenser 172 is fitted into target vessel exit 170.

By having the helium stream pass through the target material prior to exiting onto the target material surface, the helium stream can act as a coolant of the target material to control the target material temperature, while avoiding cooling of the surface below the melting point of the target material.

The subject invention provides a large number of advantages over previously employed processes. High efficiency is obtained in the yield of the desired radionuclide based on the amperage of the radiation beam. The product is found to be radionuclidically pure except for extremely minor amounts (less than about 0.1%) of the undesired radioisotope $^{125}I$. The product is also found to be sterile and pyrogen free.

By having a continuous process, losses of radioactive xenon which frequently result during batch processing because of the difficulty of sealing the target, are avoided. The continuous process reduces handling radiation hazard. Furthermore, as compared to earlier batch processing, the target can be continuously irradiated, so that interruption of the irradiation is substantially diminished.

Targets properly sealed for irradiation must be opened carefully and such opening is frequently time consuming and efficient recovery of $^{123}Xe$ difficult. During batch processing, the $^{123}I$ resulting from $^{123}Xe$ decay is frequently lost. During a two hour irradiaton, this loss can be about 25%. In the subject method $^{123}Xe$ is collected about five minutes after production and only about 3% of the activity is lost.

Experience with the subject apparatus and method has shown that on the average $^{123}I$ can be produced at a rate of 18 mCi/$\mu$Ahr. Since the target is operated at 20 a, the yield is 360 mCi/hr. This calculates out to a yield of 90% or better of the attainable yield.

The use of $^{127}I$ has many advantages over the use of other target materials, such as $^{122}Te$. One advantage is the substantial absence of undesirable radionuclide impurities. Another is that normal iodine is substantially less expensive than other target materials. Because of the expense of the target material, the target must be reused after irradiation and this results in a costly and hazardous procedure. Furthermore, the reprocessing frequently results in loss of the expensive target material and may introduce undesirable foreign material which can produce radioactive contaminants in subsequent irradiations, such as $^{24}Na$. The $^{127}I$ targets are thicker than those used in the lower energy reactions, e.g., $^{122}Te$ (d,n), $^{123}I$ and it is much easier to maintain quality control of the radioisotopes which the subject process produces. Thin targets often produce radioactive contaminants because of the variability in the target thickness.

With the use of iodine as compared to sodium iodide, there are additional advantages. There is a 20% increase in the yield of $^{123}Xe$ per $\mu$amp/hr, since the beam is not arrested by the sodium in sodium iodide. Furthermore, the release of xenon from the liquid iodine appears to be more efficient. The operating temperature is also lower and one avoids the build-up of radioactivity of radioactive isotopes of sodium, such as $^{22}Na$ and $^{24}Na$.

While the subject process has been described for the production of $^{123}I$, the process can also be used for the production of $^{125}I$ by employing a lower proton energy in the range of about 20–40 MeV, particularly 32 MeV, whereby $^{125}Xe$ is produced. The energy drop over the target vessel would be about 15–20 MeV. Since the beam exiting from the target vessel for the formation of $^{123}Xe$ will have approximately the correct energy, by employing a second target vessel behind the first target vessel, both isotopes could be obtained simultaneously.

Although the foregoing invention has been described in some detail by way of illustration and example for purposes of clarity of understanding, it will be obvious that certain changes and modifications may be practiced within the scope of the appended claims.

I claim:

1. A process for preparing $^{123}I$ which comprises:

irradiating with a proton beam in an irradiation zone a liquid sample of XI as a target material, wherein X is alkali metal or I, the protons in said beam having an energy in the range of 60–70 MeV at a power level of at least about 5 $\mu$a, wherein the thickness of the XI sample is sufficient to reduce the energy of said particles by from about 15–25 MeV and said beam irradiating a substantial portion of said liquid sample in said zone;

continuously passing a stream of helium onto the surface of said liquid sample in said irradiation zone whereby $^{123}Xe$ produced by said irradiation is entrained with said helium and carried from the irradiation zone to a condensing zone;

cooling said helium stream in said condensing zone returning XI to said irradiation zone and transferring said helium stream to a collection zone;

condensing $^{123}Xe$ by cooling said helium stream in said collection zone to a temperature below the condensation temperature of $^{123}Xe$, and collecting $^{123}Xe$ in said collection zone; and allowing $^{123}Xe$ to decay to $^{123}I$.

2. A method according to claim 1, wherein said condensed $^{123}Xe$ is transferred in vacuo by evaporation and condensation to a second vessel at a pressure below about 50$\mu$ mercury to enhance the purity of the $^{123}I$ obtained from decay of $^{123}Xe$.

3. A method according to claim 1, wherein said helium stream has from about 0–0.2 volume percent xenon and entrained $I_2$ is removed from said helium stream exiting from said condensing zone.

4. A method according to claim 1, wherein XI is sodium iodide and the temperature of said target material is in the range of about 650°–720° C.

5. A method according to claim 1, wherein XI is $I_2$ and the temperature of said target material is in the range of about 100°–130° C.

6. A method according to claim 1, wherein said helium stream is passed through said target material at a rate of about 10–60 ml per minute.

7. A method according to claim 1, wherein said helium stream is heated by said liquid sample prior to passing onto the surface of said liquid sample.

8. A method according to claim 1, wherein XI is placed in tandem in a second target zone behind said target zone having a thickness sufficient to reduce the energy of the protons' radiation exiting from said first zone by 15–20 MeV; and isolating $^{125}Xe$ produced by said radiation exiting from said first zone.

9. A method for preparing $^{123}I$ which comprises:

irradiating with a scanning proton beam in an irradiation zone a liquid sample of XI as a target material, wherein X is sodium or I, the protons in said beam having an energy in the range of 60–70 MeV at a power level of from about 10 $\mu$a to 20 $\mu$a, wherein the thickness of the XI sample is sufficient to reduce the energy of said particles by from about 15–25 MeV, while maintaining the temperature at or about the melting point of XI, but not to exceed 100° C. above the melting point of XI and said beam irradiating a substantial portion of said liquid sample in said zone;

continuously passing onto the surface of said target material in said irradiation zone a helium stream containing up to 0.2 volume percent xenon, whereby $^{123}$Xe produced by said irradiation is entrained with said helium and carried from said irradiation zone to a condensing zone;

cooling said helium stream in said condensing zone and returning condensed XI to said irradiation zone;

removing any entrained $I_2$ from said helium stream exiting from said condensing zone and transferring the substantially $I_2$ free helium stream to a collection zone;

condensing $^{123}$Xe by cooling said helium stream in said collection zone to a temperature below the condensation temperature of $^{123}$Xe and collecting $^{123}$Xe in said collection zone; and transferring said condensed $^{123}$Xe in vacuo by evaporation and condensation from said collection zone to a decay zone where $^{123}$Xe decays to $^{123}$I to provide high purity $^{123}$I.

10. A method according to claim 9, where XI is NaI.

11. A method according to claim 9, where XI is $I_2$.

12. A method according to claim 9, wherein said helium stream is heated by said target material prior to passing onto the surface of said target material.

* * * * *

UNITED STATES PATENT AND TRADEMARK OFFICE

CERTIFICATE OF CORRECTION

PATENT NO. : 4,818,468

DATED : Apr. 4, 1989

INVENTOR(S) : Jungerman et al.

It is certified that error appears in the above—identified patent and that said Letters Patent is hereby corrected as shown below:

On The Title Page, Item [75], should read

-- [75] Inventors: John A. Jungerman; Neal F. Peek; Horace H. Hines; Manuel Lagunas-Solar, all of Davis, Calif. --.

Signed and Sealed this

Thirteenth Day of February, 1990

*Attest:*

JEFFREY M. SAMUELS

*Attesting Officer*

*Acting Commissioner of Patents and Trademarks*